US005578893A

United States Patent [19]

Yamamoto

[11] Patent Number: 5,578,893

[45] Date of Patent: Nov. 26, 1996

[54] BULB FOR VEHICULAR LIGHTING EQUIPMENT

[75] Inventor: Teruaki Yamamoto, Tokyo, Japan

[73] Assignee: PIAA Corporation, Tokyo, Japan

[21] Appl. No.: 524,837

[22] Filed: Sep. 7, 1995

Related U.S. Application Data

[63] Continuation of Ser. No. 153,425, Nov. 16, 1993, abandoned.

[51] Int. Cl.[6] ..... H01J 5/16

[52] U.S. Cl. ..... 313/112; 313/115; 362/61

[58] Field of Search ..... 313/113, 115, 313/318, 172; 362/61

[56] References Cited

U.S. PATENT DOCUMENTS

| | | | |
|---|---|---|---|
| 2,020,130 | 11/1935 | Astor | 313/111 |
| 2,327,144 | 8/1943 | Stam | 362/256 |
| 3,200,282 | 8/1965 | Mickley | 313/114 |
| 3,493,806 | 2/1970 | Jacobs et al. | 313/113 |
| 3,619,695 | 11/1971 | Nameda et al. | 313/112 |
| 3,646,385 | 2/1972 | Wichert | 313/115 |
| 3,646,386 | 2/1972 | Rijnors | 313/115 |
| 4,210,841 | 7/1980 | Vodicka et al. | 313/111 |
| 4,480,296 | 10/1984 | Gagnon et al. | 362/211 |
| 4,644,452 | 2/1987 | Kasboske | 362/214 |
| 4,713,736 | 12/1987 | Kasboske | 362/214 |
| 4,839,553 | 6/1988 | Mellor | 313/111 |
| 4,951,178 | 8/1990 | Shirai et al. | 362/61 |
| 4,965,485 | 10/1990 | Tarumi et al. | 313/43 |
| 5,017,825 | 5/1991 | Heijnen et al. | 313/112 |
| 5,051,650 | 9/1991 | Taya et al. | 313/112 |
| 5,113,109 | 5/1992 | Kawakatsu | 313/112 |
| 5,142,197 | 8/1992 | Kawakatsu | 313/635 |
| 5,146,130 | 9/1992 | Kawakatsu | 313/112 |
| 5,179,318 | 1/1993 | Maeda et al. | 313/466 |
| 5,214,345 | 5/1993 | Saito et al. | 313/112 |

*Primary Examiner*—Alvin E. Oberley
*Assistant Examiner*—Lawrence D. Richardson
*Attorney, Agent, or Firm*—Oblon, Spivak, McClelland, Maier & Neustadt, P.C.

[57] ABSTRACT

The invention disclosed relates a bulb for use with vehicular lighting equipment and adapted for use therein. It comprises a glass bulb member having a multi-layered color layer, a non-color portion and light shield layer located thereon, a stem, a plurality of inner leads, a pair of filaments, a metallic shield member, a plug, etc. As combined with a reflector in vehicular lighting equipment, the bulb enables change of its beam in orientation and in color by selective operation of the filaments.

1 Claim, 4 Drawing Sheets

BULB FOR VEHICULAR LIGHTING EQUIPMENT

This application is a continuation of application Ser. No. 08/153,425, filed on Nov. 16, 1993, now abandoned.

BACKGROUND OF THE INVENTION

This invention relates to a bulb for use in a reflector-containing vehicular equipment such as headlights, etc. Conventionally, two types of lighting equipment for headlights have been known, one and the other for the so-called high and low beam bulbs. The first one operates to project the light beam forward. The second operates to orient its light flux downward enough to avoid glare of the driver who drives continuously in the opposite direction insofar as the visibility is maintained. Thus, two lateral pairs of, that is, four, high and low beam lighting fixtures had to be equipped in a car. In case that a pair of high beam equipment are located outermost of the car body to indicate the body width, another pair of low beam equipment must be located inside or lowerside of the high beam equipment. If they are inside, the possibility increases that the body width is erroneously indicated to the driver driving adjacently in the opposite direction, thus adding to causes of traffic accident. If they are lower, they might not disadvantageously project the light beam for a good distance as the light beam therefrom is oriented downwards. This invention will overcome these drawbacks of the prior art light equipment.

SUMMARY OF THE INVENTION

According to one feature of the invention, a plurality of filaments are disposed in one single vehicular bulb and can be selectively actuated to selectively change its beam orientation in combination with the associated light equipment.

When the light beam is oriented downwards, according to the other feature of the invention, blue components are substantially eliminated from the light beam radiating from a vehicular bulb for diminishing glare of the opposedly, adjacently opposed driver.

According to the still other feature of the invention, a vehicular bulb has a multilayered film disposed outside, instead of a color filter, for eliminating the blue components from the light beam radiating from the filaments, without undesirable increase of temperatures of the glass bulb envelop and decrease of the light amount available, thus prolonging the lifespan of the bulb.

Advantageously, this invention provides a bulb functioning for two in lighting equipment, thus making designing of the vehicular body front freer than in the conventional-art.

BRIEF DESCRIPTION OF THE ACCOMPANYING DRAWINGS

DETAILED DESCRIPTION OF THE PREFERRED EMBODIMENTS

Figure 1A:
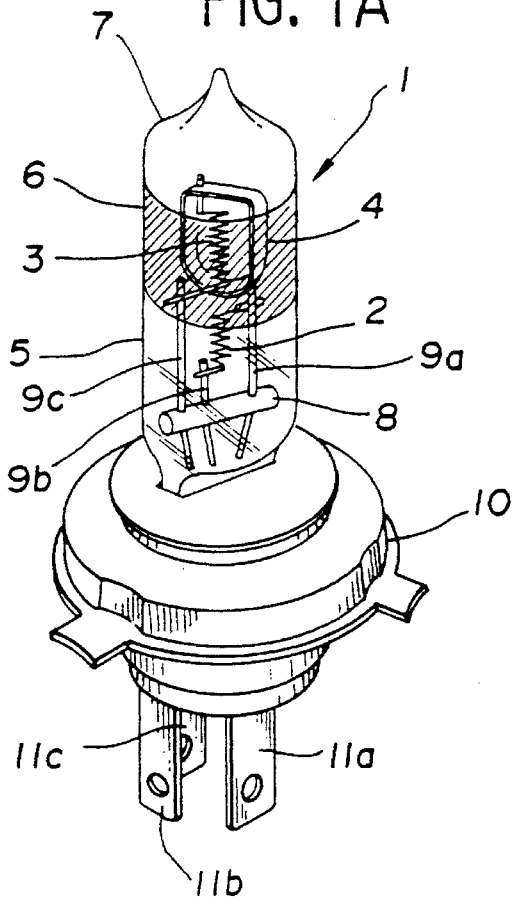
FIGS. 1A, 1B and 1C are perspective, lateral and planar views, respectively, showing a bulb of the invention.
Figure 1B:
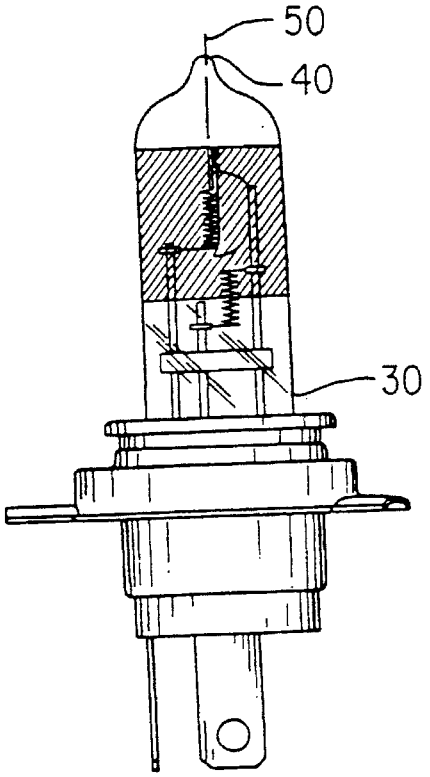
Figure 1C:
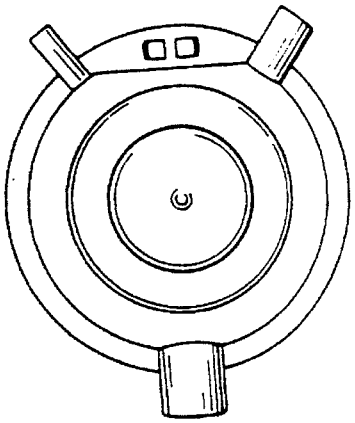

There is shown in FIGS. 1A, 1B and 1C a bulb designated at 1 and constituted by a glass bulb enclosure member 5 in which a pair of tungsten filaments 2 and 3 are supported on tungsten rod inner leads 9*a*, 9*b*, 9*c* raised from a stem 8. A metallic shield member 4 is disposed adjacent the filament 3 and extends along said substantially the entire length of filament 3. As shown in FIG. 1(*b*), filament 3 is aligned with a longitudinal axis 50 of the bulb 1. The top end portion 7 of glass member 5 is covered by a light impermissive material which is followed by a glass member portion 6 having oxide thin films of either titanium and silicon and/or the like or tartar and silicon and/or the like vacuum-deposited or dipping-formed thereon in the form of a long wavelength permissive multilayered film. It tends to reflect the blue components radiating from the filament 3 inward of the bulb and prevent the same from projecting therefrom, so that a light energy is emitted which has a power peak in wavelengths of 500 nanometers or more. The bulb member has a flange 10 for positioning the bulb relative to an associated lighting equipment reflector, and connection pins 11*a*, 11*b*, 11*c* serving to electrically and physically connecting the bulb to the lighting equipment in the corresponding socket.

Figure 2:
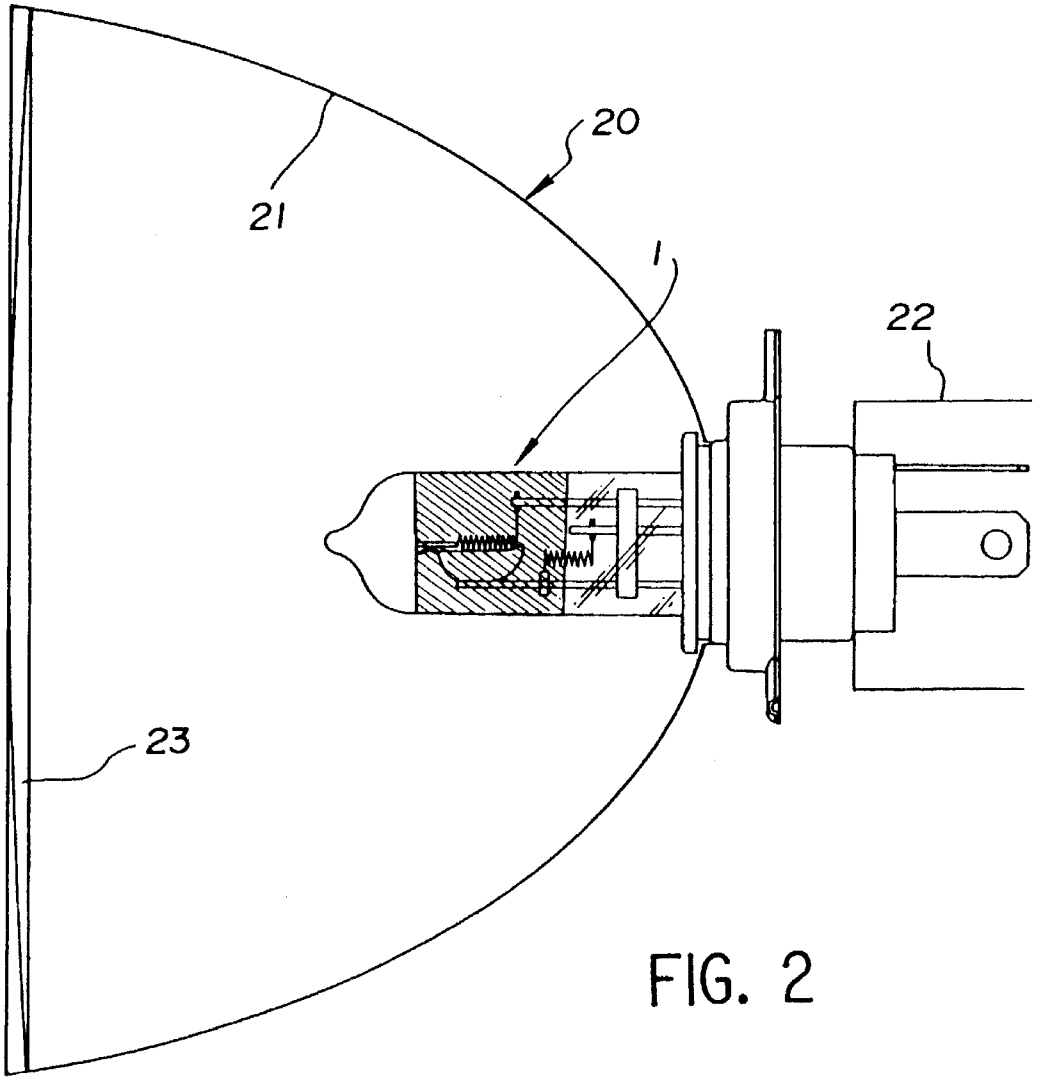
FIG. 2 is a cross-sectional view of the bulb mounted in lighting equipment.

The bulb is mounted in lighting equipment as shown in a cross-section of FIG. 2. The equipment 20 has a parabolic reflector 21 and a socket 22 for securing a bulb therein. The reflector 21 has a protection member 23 in its forward opening for protecting the bulb and reflector. The bulb is arranged with equipment so that one of filaments 2 and 3 close to the plug is located coincidentally with the focal point of the parabolic surface of the reflector, while the other is remotely located therefrom.

Figure 3:
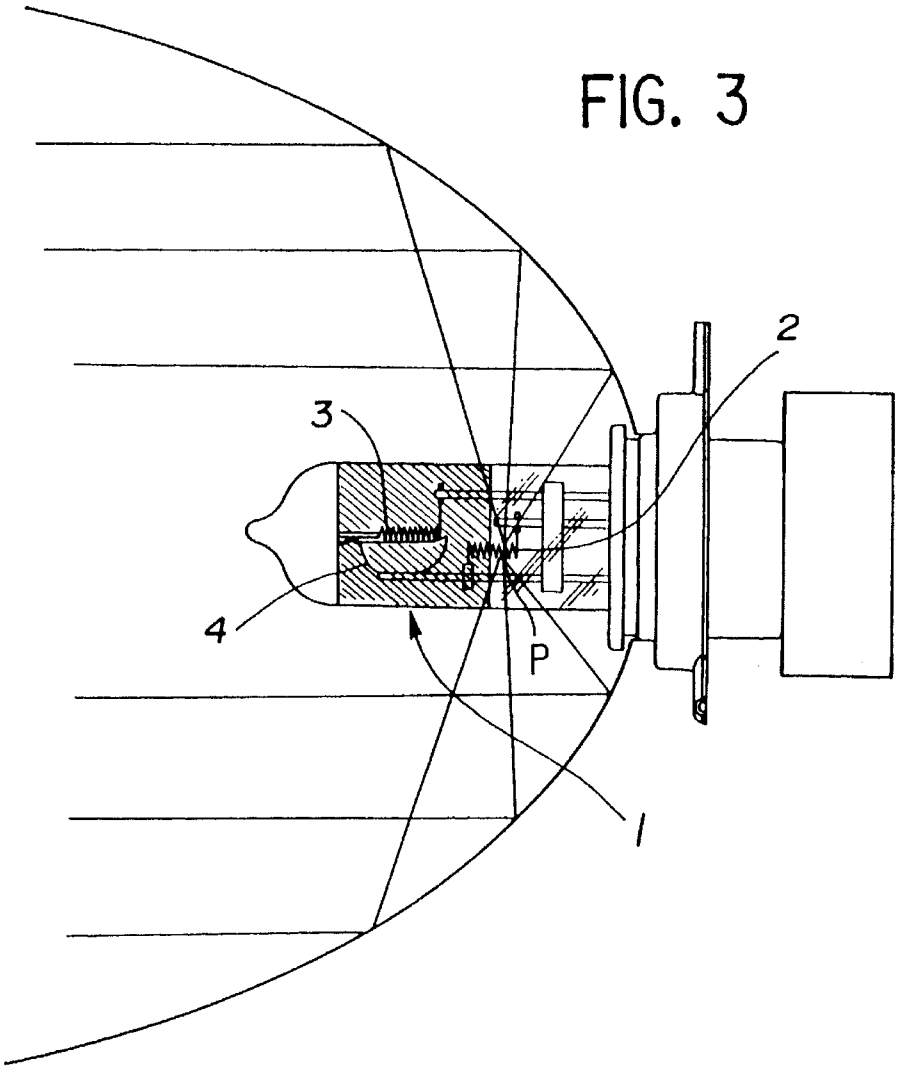
FIG. 3 and 4 show light flux orientations made when the bulb actuates for high and low beams, respectively.
Figure 4:
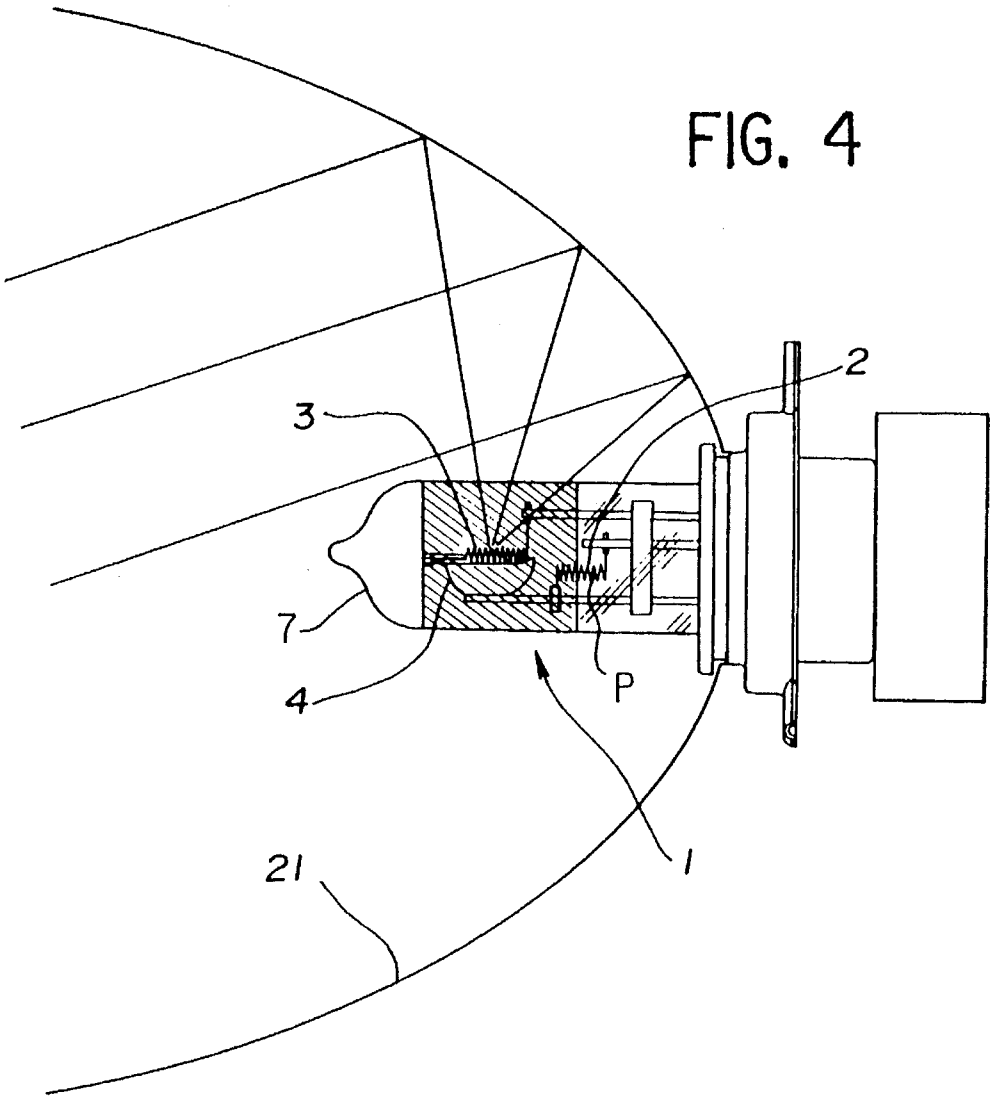

The coincidence of the light source with the focal point creates a substantially parallel light flux as shown in FIG. 3, making the optical system optimal for lighting distant places. In an optical system where a light source is located outside of the focal point of the reflector, as shown in FIG. 4, the flux will converge in a forward point and then diverge. When the source is inside of the reflector beyond the focal point, the flux will diverge without convergence.

As the other filament 3 of the bulb is found outside of the focal point of the reflector as the one being on the focal point, it is to be understood that the ray therefrom will converge and subsequently diverge. The metallic shield member 4 is located in a lower position as the bulb is mounted on the equipment, the beam emitting downward from the filament 3 is blocked from being radiated outside of the bulb while the remaining beam therefrom impinges on the inner surface of the reflector and propagate in downwardly crossing direction of the optical axis. The flux created by the filament 3 is projected in a downward direction relative to the optical axis of the reflector.

From the foregoing description, it is to be understood that selective actuation of filaments 2 or 3 creates a high beam propagating in parallel with the optical axis of the reflector or a low beam going downwardly crossing the same axis, thus avoiding generation of glare of the oppositely adjacently passing driver.

No color is applied to the glass bulb portion corresponding to the filament 2 so that substantially no power loss is had by a high beam by the filament. The glass bulb portion corresponding to filament 3 has four or preferably 8 to 16 or at most 24 layers of either titanium and silicon and/or the like or tantar and silicon and/or the like vacuum-deposited or dipping-applied thereon in the form of a long wavelength permissive multilayered film of a thickness of 1 to 5 micrometers, thus allowing radiating rays having its power peak above 500 nanometers. It was found that a multilayered film of 5 micrometers or thicker or a film having 24 layers or more were likely to delaminate or crack and that a film of 1 micrometer or thinner or one having 3 layers or fewer did not serve to filter the desired waveband. The long wavelength permissive film substantially eliminates blue components from the downward oriented beam, thus reducing possibility of glare of the oppositely running driver.

In a bulb for use in vehicular lighting equipment, the invention provides said bulb comprising a glass bulb member, at least two metallic stems parallel with the center line of the bulb member, a first filament located in the side of rearward end of the bulb member in parallel with the metallic stems, a second filament in the side of forward end thereof, a shield located in parallel with the second filament, the filaments having ends secured to the metallic stems or the like, a light shield means applied in the forward end of the bulb, a plug disposed in the rearward end thereof, the bulb being adapted to be mounted in lighting equipment with a reflector so as to dispose the metallic stems in horizontal direction with said shield located below the center line of the bulb whereby radiation flux is oriented by means of said shield and said reflector when said second filament is actuated, said bulb having oxide thin films of either titanium and silicon and/or the like or tantar and silicon and/or the like vacuum-deposited or dipping-formed on a corresponding portion to said second filament in the form of a long wavelength permissive multilayered film thereby to convert the passing rays from second filament into a colored beam having a peak at wavelength band of 500 nanometers or more as if it passed through a colored layer.

What is claimed is:

1. A bulb assembly for use in vehicular lighting equipment, said bulb assembly comprising, a reflector having a focal point, a glass bulb member having a centerline, a first filament located in proximity with a rearward end of the bulb member, a second filament located in proximity with a forward end of the bulb member wherein said first filament is located so as to coincide with the focal point wherein said second filament is aligned with the centerline of the glass bulb and remote from the focal point such that a substantially parallel light flux is created for lighting distant locations, a shield located within the bulb and parallel with the second filament, a light shield located on the bulb at the forward end of the bulb and located forward of the focal point, a plug disposed at the rearward end of the bulb, the bulb being mounted in lighting equipment with a reflector such that radiation flux is oriented by said shield located within the bulb and said reflector when said second filament is actuated, said bulb having oxide thin films which are dipped-coated on a portion of said bulb corresponding to said second filament so as to form a long wavelength permissive multilayered film on said bulb wherein said films comprise layers of dipped-coated films having a thickness of 1.2 to 1.8 micrometers thereby to convert light rays passing from said second filament into a colored beam having a peak wavelength band of at least 500 nanometers.

* * * * *